United States Patent [19]

Helt

[11] 4,117,609

[45] Oct. 3, 1978

[54] RIP CORD SAFETY DEVICE FOR WADERS

[75] Inventor: Raymond E. Helt, Pocatello, Id.

[73] Assignee: Rass, Inc., Pocatello, Id.

[21] Appl. No.: 781,193

[22] Filed: Mar. 25, 1977

[51] Int. Cl.[2] ..... A43B 1/10

[52] U.S. Cl. ..... 36/4; 2/227; 36/50; 206/616

[58] Field of Search ..... 2/227, 82; 36/45, 57, 36/50, 4, 1.5, 2 R; 206/616; 223/75

[56] References Cited

U.S. PATENT DOCUMENTS

| | | | |
|---|---|---|---|
| 848,821 | 4/1907 | Glidden | 36/4 |
| 1,532,432 | 4/1925 | Morse | 223/75 |
| 2,654,964 | 10/1953 | Stoll | 36/50 X |

*Primary Examiner*—H. Hampton Hunter
*Attorney, Agent, or Firm*—K. S. Cornaby

[57] ABSTRACT

A rip cord safety device providing an easy escape means from wading boots filled and drawing the wearer beneath the water. The rip cords are positioned so as to open the wading boots from toe to top with a single upward pulling motion.

6 Claims, 4 Drawing Figures

FIG. 1.
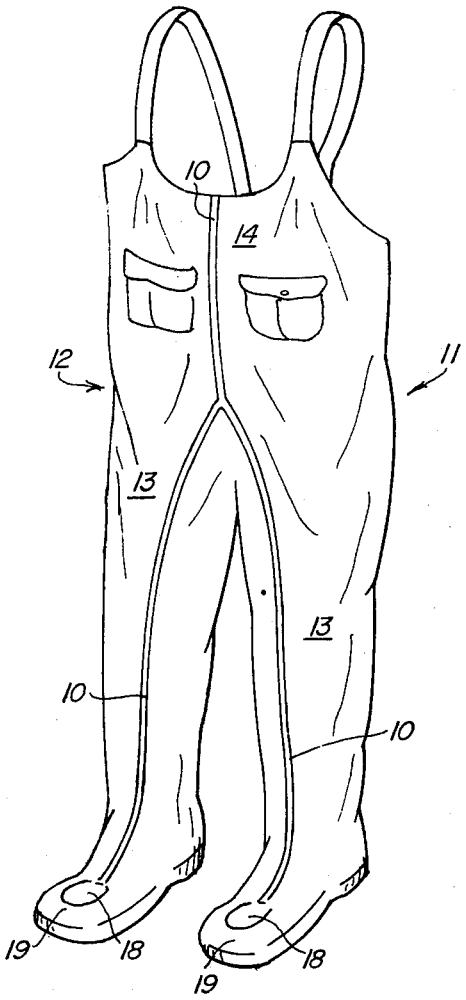
FIG. 3.
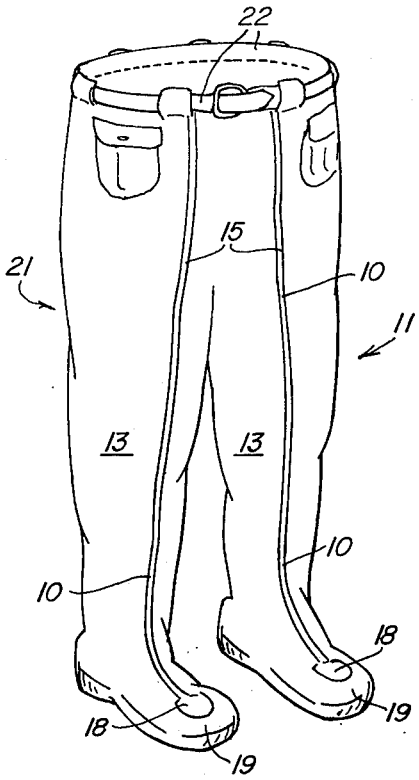
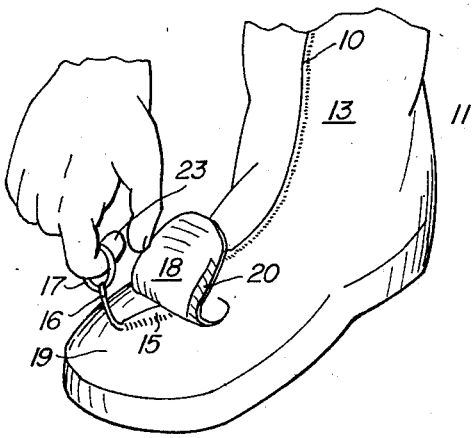
FIG. 2.
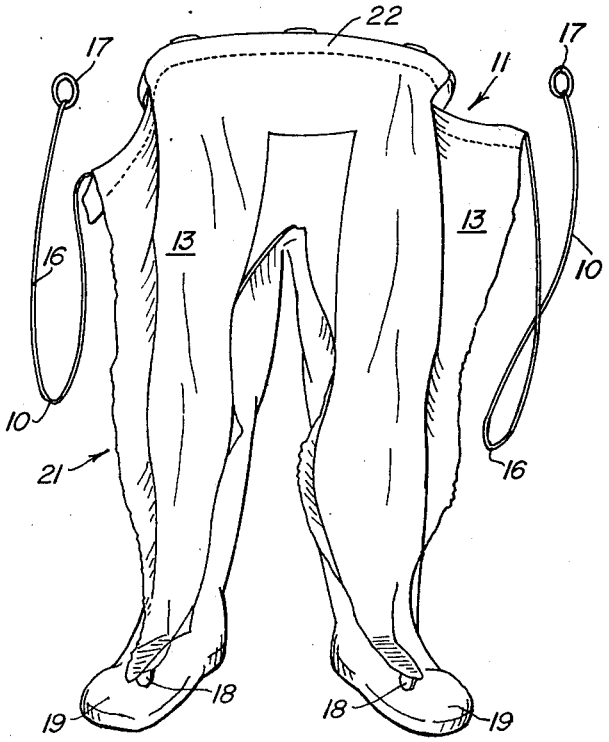
FIG. 4.

RIP CORD SAFETY DEVICE FOR WADERS

BACKGROUND OF THE INVENTION

This invention relates to the field of safety devices for wading boots.

Boots used for wading in lakes, streams, and other water bodies have generally been known for many years. Such boots provide flexible movement and protection from moisture seepage. Numerous improvements to accomplish a variety of objectives have been made, but a problem has remained heretofore unsolved. Prior to the making of this invention, waders presented a serious hazard under certain conditions. If one should step into the depths of water, while wearing wading boots, the boots would quickly fill and pull the wearer beneath the water. In a state of panic and immersed, the wearer would find the boots difficult to remove. There have been many instances where this problem has proved fatal.

It is an object of the present invention to eliminate the hazard recognized by providing a flexible and comfortable waterproof wading boot that permits the wearer to eject the boot in a quick simple movement.

SUMMARY OF THE INVENTION

The rip cord safety device of the invention has cords sealed into the walls of a wading boot that extend the length of the front of the wader. The cord is sealed into the inside of the boot wall. When the cord is pulled with a single upward motion, the boot will open and allow the wearer to escape. The sealing material permits waterproofing, flexibility, and easy ejection from the wading boot. The rip cord has a ring attached at the end of the cord. The ring is disposed on the toe of the boot and beneath a protective flap. The flap prevents opening of the wader by inadvertantly snagging the rip cord ring.

THE DRAWINGS

The preferred embodiments of the invention are illustrated in the accompanying drawings, in which:

FIG. 1 is a perspective view of bib-type chest waders with the rip cord safety device disposed within the boot walls and joining at the chest;

FIG. 2 is a perspective view of the foot portion of a wader showing the rip cord ring, exposed from beneath a flap;

FIG. 3 is a perspective view of pant-type waders with the rip cord safety device disposed within the boot walls and extending from each toe to the waist;

FIG. 4 is a perspective view of the pant-type waders after the rip cord has been pulled and the boot has been opened.

DETAILED DESCRIPTION OF THE ILLUSTRATED EMBODIMENT

As shown in FIGS. 1 and 2, a preferred embodiment of the rip cord safety device has a rip cord 10 sealed within the wall of a wading boot 11 and extending the length of said boot 11. With the bib-type chest waders 12, as illustrated in FIG. 1, the rip cord 10 extending from each leg 13 unites in the abdomen area of the bib 14 and runs singularly to the top of the bib 14. It is understood that more rip cords 10 may be used within each leg 13 wall; however one is preferred. It is also understood that each rip cord 10 need not unite in the bib 14 area and extend upward singularly to the bib's 14 top; however, for ease of operation, the united cord assembly is preferred. The rip cords 10 are sealed within the boot's 11 inside wall by a flexible rubber coating 15. The rubber coating 15 is light enough to not impede the rip cord's 10 operation. To maintain the wader 12 as waterproof, the rubber coating 15 is water resistant. It is understood that any material having these qualities may be used; however, the rubber coating 15 is preferred.

As shown in FIG. 2 the rip cord 10 is comprised of a cord 16 with a ring 17 attached at the end thereof. The cord 16 is constructed of a braided stainless steel for flexibility, noncorrosiveness, and strong tensile strength. It is understood that any material having these qualities may be used; however, the braided stainless steel is preferred. The ring 17 is concealed beneath a protective flap 18 on the boot toe 19. Said flap 18 is disposed to prevent inadvertant snagging of the ring 17 while a wearer is wading or walking. A stay 20 is (may be) inserted within the flap 18 to maintain its disposition over the ring 17, as shown in FIG. 2.

An alternative preferred embodiment is shown in FIGS. 3 and 4. The pant-type wader 21 has a pair of rip cords 10 extending from the boot toe 19 to the waist 22. The rubber coating 15 and the rip cord 10 is the same as in the preferred embodiment illustrated in FIG. 1. It is understood that the rip cord 10 may also be used on the hip-type waders, comprised of a pair of separate boots 11.

The wearer is provided an easy one-time escape means if his waders 12 and 21 fill and drawn him beneath the water. As shown in FIGS. 2 and 4, the rip cord 10 operates to open the boot 11 when the wearer inserts his finger 23 into the ring 17 and pulls upward. The rubber coating 15 splits, opening the boot 11 and permitting the wearer to escape.

It is understood that the particular forms of the invention described herein and illustrated in the accompanying drawings are preferred embodiments. Various changes in shape, size, materials, and arrangement of parts may be made without departing from the spirit of the invention as defined in the attached claims.

I claim:

1. A rip cord safety device providing a means of opening waders of bib-type to escape therefrom, comprising in combination:
   - a cord disposed within the walls of each wader boot and extending upwardly from each boot toe to the abdomen area, said cords uniting in said abdomen area and then extending upwardly as a single cord to the top of the bib;
   - a ring attached to the toe end of each cord at the toe;
   - a waterproof coating for sealing said cord within said wader walls; and
   - a flap for disposing over the ring on the toe of the waders.

2. A rip cord safety device as set forth in claim 1, wherein said flap has a stay disposed to maintain the flap over the rip cord ring.

3. A rip cord safety device as set forth in claim 1, wherein said rip cord is sealed into the wader's wall with a light, waterproof rubber coating.

4. A rip cord safety device as set forth in claim 1, wherein said rip cord is constructed of braided stainless steel.

5. A rip cord safety device as set forth in claim 1, wherein said rip cord ring is of a diameter sufficient to allow the wader wearer's finger to be inserted for grasping.

6. A rip cord safety device as set forth in claim 1, wherein said rip cord ring is metal.

* * * * *